US008752217B1

(12) United States Patent
Cheney

(10) Patent No.: US 8,752,217 B1
(45) Date of Patent: Jun. 17, 2014

(54) MULTI-PART, MOLDED ATHLETIC CUP

(75) Inventor: Scott F Cheney, Hanson, MA (US)

(73) Assignee: Franklin Sports, Inc, Stoughton, MA (US)

( * ) Notice: Subject to any disclaimer, the term of this patent is extended or adjusted under 35 U.S.C. 154(b) by 818 days.

(21) Appl. No.: 12/550,356

(22) Filed: Aug. 29, 2009

(51) Int. Cl.
*A41D 13/05* (2006.01)
*A41D 13/00* (2006.01)

(52) U.S. Cl.
USPC ..... 2/466; 2/23; 2/400; 2/403; 2/404; 2/406; 128/846; 128/891; 602/67; 602/70; 602/71; 602/72

(58) Field of Classification Search
USPC ..... 2/466
See application file for complete search history.

(56) References Cited

U.S. PATENT DOCUMENTS

| | | | | | |
|---|---|---|---|---|---|
| 1,972,275 | A | | 9/1934 | Record | |
| 2,283,684 | A | | 5/1942 | Matthews | |
| 3,176,686 | A | | 4/1965 | Barnes | |
| 3,483,147 | A | * | 12/1969 | Friedman | 521/169 |
| 3,782,375 | A | | 1/1974 | Donars | |
| 3,961,124 | A | * | 6/1976 | Matton | 442/103 |
| 4,134,400 | A | | 1/1979 | DiMatteo | |
| 4,257,414 | A | | 3/1981 | Gamm et al. | |
| 4,429,068 | A | * | 1/1984 | Nakahira | 524/302 |
| 4,453,541 | A | | 6/1984 | Castelli et al. | |
| 4,485,204 | A | * | 11/1984 | Nabors | 524/430 |
| 4,616,065 | A | * | 10/1986 | Hargis et al. | 525/99 |
| 4,922,899 | A | | 5/1990 | Graff et al. | |
| 5,479,942 | A | | 1/1996 | DiMatteo | |
| 6,319,219 | B1 | | 11/2001 | Landi | |
| 7,004,921 | B2 | | 2/2006 | Littell | |
| 7,178,176 | B1 | | 2/2007 | S-Cronenbold | |
| 7,296,307 | B2 | * | 11/2007 | Atwater et al. | 2/466 |
| 2003/0195329 | A1 | * | 10/2003 | Funakoshi et al. | 528/370 |
| 2004/0024341 | A1 | * | 2/2004 | Jacobs | 602/72 |
| 2004/0040182 | A1 | * | 3/2004 | McMullin | 36/134 |
| 2004/0237172 | A1 | * | 12/2004 | Quinn | 2/209.13 |
| 2005/0000118 | A1 | * | 1/2005 | McMullin | 36/134 |
| 2005/0278839 | A1 | * | 12/2005 | Atwater et al. | 2/466 |
| 2006/0230639 | A1 | * | 10/2006 | McMullin | 36/134 |
| 2007/0269647 | A1 | * | 11/2007 | Wu et al. | 428/317.9 |
| 2008/0271229 | A1 | * | 11/2008 | Steszyn et al. | 2/466 |

OTHER PUBLICATIONS

"Styrene-butadiene rubber." McGraw-Hill Dictionary of Scientific and Technical Terms. McGraw-Hill Companies, Inc., 2003. Answers.com May 28, 2010. http://www.answers.com/topic/styrene-butadiene-rubber.*

"Acrylonitrile butadiene styrene resin." McGraw-Hill Dictionary of Scientific and Technical Terms. McGraw-Hill Companies, Inc., 2003. Answers.com May 28, 2010. http://www.answers.com/topic/acrylonitrile-butadiene-styrene-resin.*

"Butadiene." The American Heritage® Dictionary of the English Language, Fourth Edition. Houghton Mifflin Company, 2004. Answers.com May 28, 2010. http://www.answers.com/topic/butadiene.*

* cited by examiner

*Primary Examiner* — Bobby Muromoto, Jr.
(74) *Attorney, Agent, or Firm* — Joseph B Bowman

(57) ABSTRACT

An integrally molded, multi-part athletic protector with a rigid upper core cup, a semi-rigid lower scrotal bridge joined to the lower edge of the rigid core cup and adapted for both longitudinal and lateral flexion, and a flexible marginal cushion lining the interior surfaces of the core cup and scrotal bridge with a rolled peripheral edge contoured to the user's body.

20 Claims, 3 Drawing Sheets

MULTI-PART, MOLDED ATHLETIC CUP

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to an athletic cup. More specifically, this invention relates to a multi-part, molded athletic cup with regions of flexure to enhance wearing comfort.

Devices for the protection of the male groin region are extensively utilized in athletics. In athletic competition, particularly body contact sports such as football, baseball, hockey, soccer and the like, protective devices are worn by the players to avoid injury due to inadvertent blows to the groin area. The most common protective device includes a rigid cup supported by a fabric athletic supporter or compression shorts. Protective cups of this character are usually formed from a plastic material, such as polypropylene or polyethylene, which is sufficiently rigid to retain its shape even when struck a relatively severe blow.

Historically, protective cups have been provided with a resilient padding around their periphery both for the comfort of the wearer and, in some measure, to absorb the impact of a blow to the cup. The resilient padding is usually formed from a soft, flexible foam-like material, such as foam rubber or polyurethane foam, and is usually provided in the form of a limited elongated strip manually attached to the peripheral edge of the cup with the aid of an adhesive. Such conventionally padded cups suffer a number of disadvantages and limitations. For instance, the pad attachment procedure is both time consuming and costly, and the bond between the padding and the protective cup is often deficient. Separation of the padding and the protective cup typically occurs during repeated use of the protector when the padding is peeling away from the restricted area of attachment to the cup. Furthermore, such known structures, in view of the restricted extent of the padding, offer only limited impact absorption protection. Consequently, upon impact a significant portion of the blow is transferred to the body of the wearer. Examples of athletic protector cups incorporating such conventional peripheral padding are provided in U.S. Pat. Nos. 2,283,684; 3,782,375; 4,453,541 and 4,134,400.

U.S. Pat. No. 4,257,414 discloses an athletic protector cup having a resilient peripheral binding molded to a peripheral cup flange. The molded binding structure disclosed in this patent provides some benefits vis-à-vis the aforementioned conventional padded cup structures. For instance, molding provides a more efficient and cost-effective means of attachment than a conventional adhesive foam strip. Furthermore, the disclosed binding is contoured to have a relatively thick outwardly-extending body portion for providing improved comfort to the wearer and improved impact absorption. However, the athletic cup structure disclosed in this patent has some significant drawbacks and limitations. For instance, to prevent separation of the molded binding from the cup over time, the cup must be manufactured having a series of perforations along the flange. In other words, to achieve adequate attachment of the binding to the cup flange, the binding material is required to flow through relatively small perforations during assembly. This is necessary to provide interlocks integrally connecting the portions of the binding lying on opposite sides of the flange. Furthermore, the relative increase in impact resistance provided by the disclosed flange geometry leaves significant room for improvement. This is because only a limited area of hard-shell is covered by soft binding. Additionally, the disclosed binding surface geometry of the outwardly extending body portion includes sharp edges which could result in chafing during frictional contact with the wearer's body.

U.S. Pat. No. 6,319,219 solves some of the foregoing shortcomings of the prior art by providing a hard-shell base cup overmolded exteriorly with a resilient material to cushion the marginal edges of the cup itself. The exterior layer wraps around the edges of the base cup to form an interlocking lip to capture the base cup and may project outwardly on the longitudinal sides of the cup to form cushioning side flanges to contact the user's body.

In spite of the past efforts to achieve a more comfortable athletic protector by providing cushioning material to the cup margins, the prior art devices remain characterized as irritating, chafing, ill fitting, and limiting to the body's natural range of motions in the lower groin area. It is believed that the design flaws inherent in the prior art devices which result in irritation, chafing, discomfort and range of motion limitation are caused by lack of longitudinal and lateral flexure of the protector, particularly in the lower groin area.

Therefore, a need remains in the field of competitive sports for a more comfortable, less irritating athletic cup which permits greater flexibility and range of motion for the user engaged in contact sports activities that require running, jogging, cross-over leg movements, bending and squatting. The primary objective of this invention is to meet this need.

SUMMARY OF THE INVENTION

More specifically, an object of the invention is to provide a multi-part athletic cup which is comfortable to wear without sacrificing resistance to impact blows.

Another object of the invention is to provide a multi-part athletic cup which permits a broader range of motion over traditional athletic cups, without the chafing, rubbing and irritation normally associated with athletic cups during strenuous exercise.

A further object of the invention is to provide a multi-part athletic cup of the character previously described and being adapted to achieve both longitudinal and lateral flexion in the lower groin area for unrestricted movements by the user.

In summary, an object of the invention is to provide an integrally molded, multi-part athletic protector with a rigid upper core cup, a semi-rigid lower scrotal bridge joined to the lower edge of the rigid core cup and adapted for both longitudinal and lateral flexion, and a flexible marginal cushion lining the interior surfaces of the core cup and scrotal bridge with a rolled peripheral edge contoured to the user's body.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
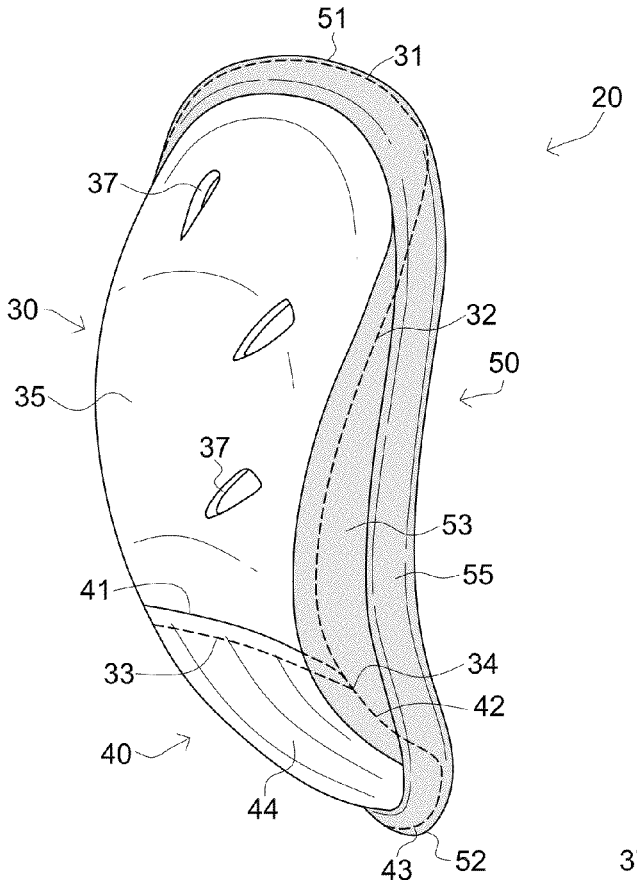
FIG. 1 is a front perspective view of a multi-part, molded athletic protector constructed in accordance with a preferred embodiment of the invention.
Figure 2:
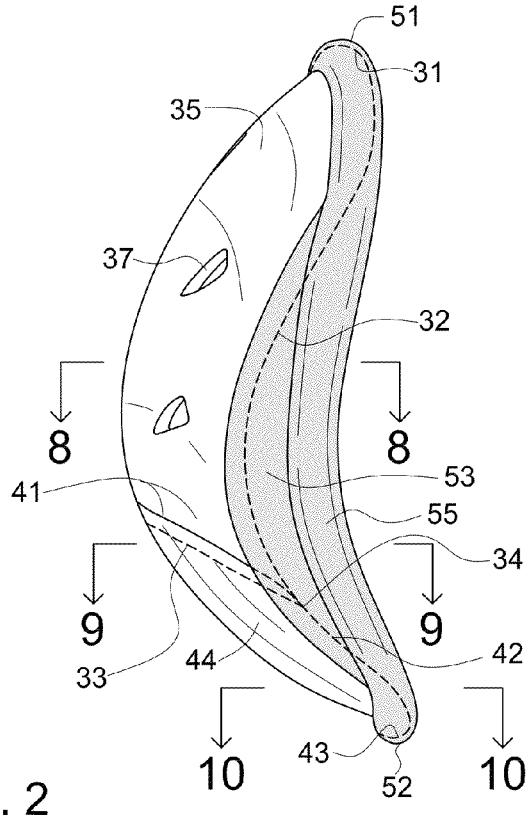
FIG. 2 is a side elevational view of the multi-part, molded athletic protector.

Referring to the drawings in greater detail, attention is first directed to the illustrations of FIGS. 1 & 2 showing a three-part molded athletic protector 20 comprising three principal parts. These include a rigid upper core cup generally designate by the numeral 30, a semi-rigid, lower scrotal bridge generally designated by the numeral 40 and a flexible marginal cushion generally designated by the numeral 50.

The rigid upper core cup 30 is generally shaped as a concave cup. It has an upper end, rolled edge 31, shown in broken line, curvilinear side margins 32 shown in broken line, and a lower arched margin 33 shown in broken line. The side margins 32 and the lower arched margin 33 meet at terminal points 34. The rigid upper cup 30 includes an outer, exterior surface 35 and an interior surface 36 within the concave shape of the structure. Both the side margins 32 and the lower arched margin 33 are tapered or contoured from the exterior surface 35 to the interior surface 36 to provide bonding surfaces for the adjacent marginal cushion 50 and scrotal bridge 40, respectively, as will be later described. A plurality of ventilation holes 37 extend through the material forming the rigid upper cup 30 to provide air flow.

The rigid cup 30 is molded from an impact plastic, such as a polypropylene or polyethylene or combination polypropylene/polyethylene material, in order to provide a rigid form which exhibits little or no flexure and provides a sturdy shield to impact blows thereto. Most preferably, the upper cup 30 is molded from propylene/ethylene copolymer pellets as specified by CAS Registry No 9010-79-1 of the American Chemical Society. Such molding materials have a specific gravity in the range of 0.88 to 0.92 and a melting point greater than 150° C. An acceptable molding material meeting these criteria is marketed under the name Globalene supplied by Taiwan Polypropylene Co., LTD (TPP), 2 Ching Chien Road, Ta She, Kaohsiung Taiwan.

The semi-rigid, lower scrotal bridge 40 includes an upper arched edge 41 joined to the lower arched margin 33 of the rigid core cup 30, and tapered side edges 42 which terminate in a narrow, lower rolled end 43. The scrotal bridge 40 includes an outer, exterior surface 44 and an interior surface 45. The upper arched edge 41 is tapered or contoured from the interior surface 45 to the exterior surface 44 to match the corresponding taper or contour of the lower arched margin 33 of the cup 30 in order to provide mating surfaces for bonding the scrotal bridge 40 to the cup 30.

Figure 3:
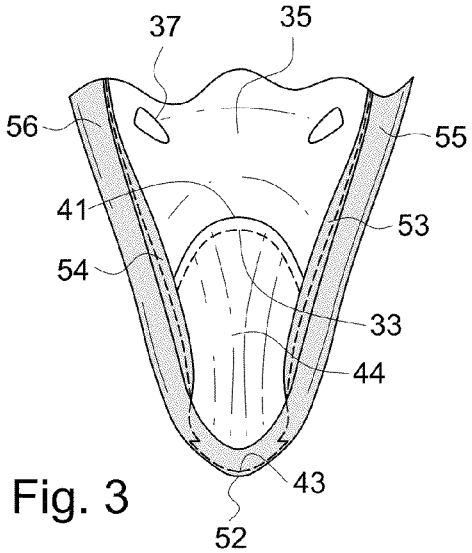
FIG. 3 is a fragmentary, front elevational view illustrating an unflexed lower scrotal bridge joined to a portion of the rigid cup member.
Figure 4:
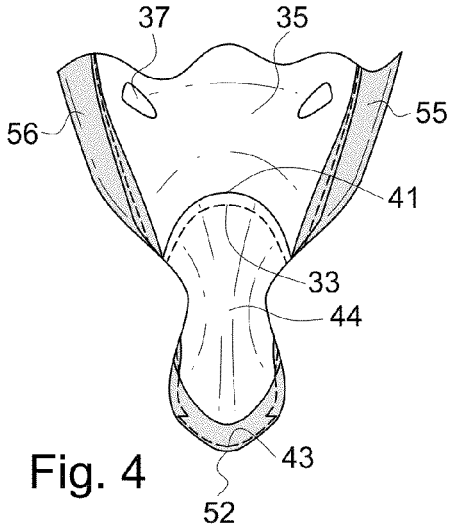
FIG. 4 is a fragmentary, front elevational view similar to FIG. 3 but illustrating the lower scrotal bridge being laterally flexed.
Figure 6:
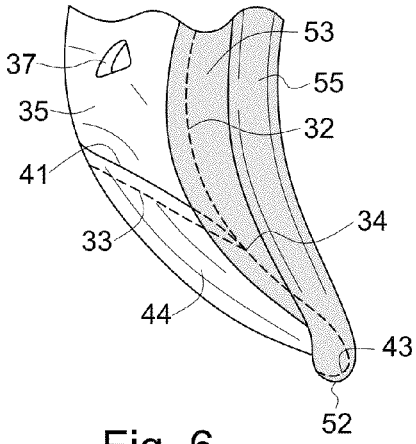
FIG. 6 is a fragmentary, side elevational view illustrating an unflexed lower scrotal bridge joined to a portion of the rigid cup member.
Figure 7:
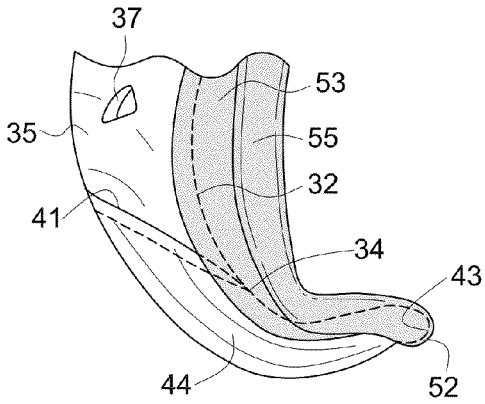
FIG. 7 is a fragmentary, side elevational view similar to FIG. 6 but illustrating the lower scrotal bridge being longitudinally flexed.

The scrotal bridge 40 is molded from a thermal setting plastic rubber, such as styrene-butadiene copolymers having a chemical formula $C_8H_8$,$C_4H_6$ and a specific gravity in the range of 0.90 to 0.95, to provide a semi-rigid form which exhibits both longitudinal flexure as shown in FIG. 7 and lateral flexure as shown in FIG. 4 with the ability to rebound to its original shape as illustrated in FIGS. 6 & 3, respectively. Most preferably, the bridge 40 is molded from styrene-butadiene copolymer as specified by CAS Registry No 9003-55-8 of the American Chemical Society.

Depending upon the degree of flexure desired for the bridge 40, the molding material selected may have a Shore A durometer in the range of 20 to 90. For sports with little or no contact, preference would be toward the lower end of the range. On the other hand, for a sport like hockey, for example, preference would be toward the upper end of the range to provide added protection when violent contact can be anticipated. For most sports, however, the bridge 40 will be molded with material having a Shore A durometer in the range 60±10, and most preferably in the range 60±5, in order to provide meaningful comfort even during strenuous activities.

Figure 5:
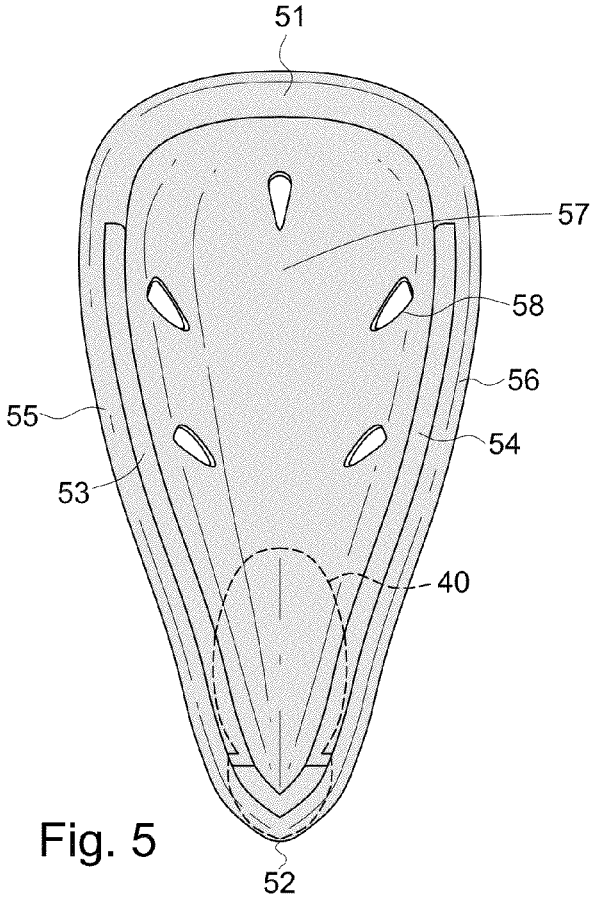
FIG. 5 is a rear elevational view of the multi-part, molded athletic protector.

At the central longitudinal axis of the protector 20, measuring length along the curvilinear shape of the structure, the rigid cup 30 comprises about 60% to 70% and the scrotal bridge 40 comprises the balance of about 40% to 30%, respectively. In lateral dimension, it will be understood with reference to FIG. 5, that the scrotal bridge 40 joins the core cup 30 only at the lower arched margin 33 thereof and is otherwise much narrower than the upper regions of the cup 30.

Figure 8:
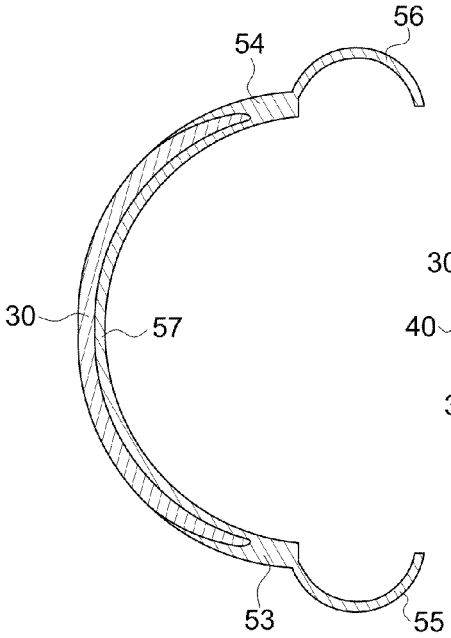
FIG. 8 is a cross sectional view taken along line 8-8 of FIG. 2 in the direction of the arrows.
Figure 9:
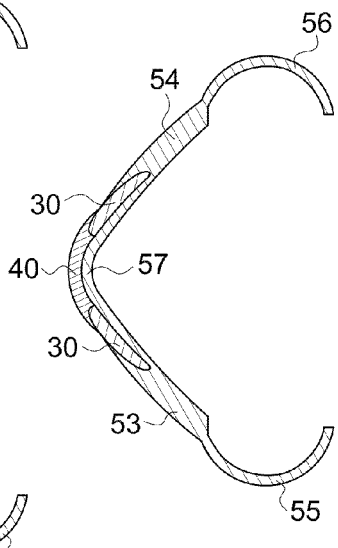
FIG. 9 is a cross sectional view taken along line 9-9 of FIG. 2 in the direction of the arrows.
Figure 10:
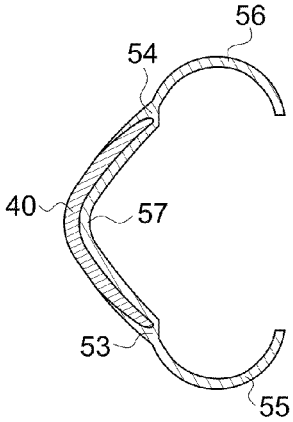
FIG. 10 is a cross sectional view taken along line 10-10 of FIG. 2 in the direction of the arrows.

The flexible, marginal cushion 50 includes an uppermost rolled edge 51 which covers the upper end, rolled edge 31 of the core cup 30, and a lowermost rolled edge 52 which covers the lower rolled end 43 of the scrotal bridge 40. Both the uppermost rolled edge 51 and the lowermost rolled edge 52 completely wrap over the adjacent upper end 31 and lower end 43 to engage respectively the exterior surface 35 of the cup 30 and the exterior surface 44 of the scrotal bridge 40. Interconnecting and integrally molded with the uppermost rolled edge 51 and the lowermost rolled edge 52 are side wings 53 & 54 joined to the side margins 32 of the core cup 30 and to the side edges 42 of the scrotal bridge 40. As best illustrated in FIGS. 8-10, side wings 53 & 54 include peripheral rolled edges 55 & 56. Covering the interior surface 36 of the cup 30 and the interior surface 45 of the scrotal bridge 40 is a sheath layer 57 interconnecting and integrally molded with the uppermost rolled edge 51, the side wings 53 & 54, and the lowermost rolled edge 52. Ventilation holes 58 extend through the sheath layer 57 to register with the ventilation holes 37 of the cup 30.

The marginal cushion 50 is molded from a thermal plastic rubber, such as styrene-butadiene copolymer having a chemical formula C8H8,C4H6, to provide a flexible cushion for contacting the user's body. The side wings 53 & 54 are sufficiently flexible to contour to the user's body in the groin region. Most preferably, the cushion 50 is molded from styrene-butadiene copolymer as specified by CAS Registry No 9003-55-8 of the American Chemical Society.

Depending upon the degree of flexure desired for the cushion 50, the molding material selected may have a Shore A durometer in the range of 20 to 50. However, the cushion 50 will be molded with material having a Shore A durometer in the range 30±5, and most preferably about 30, in order to provide meaningful comfort during strenuous sports.

Accordingly, in terms of achieving a balance between adequate protection and wearing comfort, the cup 30 will typically be molded from rigid, high impact material, the scrotal bridge 40 will be molded from semi-rigid material to provide flexure in both the longitudinal and lateral directions, and the marginal cushion 50 will be molded from softer, more flexible material than that of the other two component parts.

It should be understood that while the three principal parts have been individually described herein, the objective is to provide an integrally molded athletic protector 20 such that the component parts thereof are bonded one to the other. In carrying out this intent, the core cup 30 is first injection molded in a die corresponding to the shape of the cup 30. The resulting part is then placed in a second die being configured to form the scrotal bridge 40 formed by simultaneously injection molding the bridge 40 and bonding it to the core cup 30. The intermediate part comprising cup 30 and bridge 40 is lastly placed in a third set of injection tooling and the cushion 50 is bonded to the cup 30 and bridge 40 using a inner over-molding technique to complete the athletic protector 20.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A multi-part athletic protector comprising:

a rigid, upper cup section sized to protect the upper male groin area from impact;

a semi-rigid lower scrotal bridge section joined along the upper margin thereof to said upper cup section and adapted for multi-directional flexion while covering the lower male groin area;

a resilient cushioning section covering the outer peripheral edges of said upper and lower cup sections and overlying the entire interior surfaces of said upper and lower sections;

whereby said resilient section provides cushioned contouring of the athletic cup to the user's body, said bridge section provides flexion in at least two different directions to minimize restriction of movement of the user's body, and said cup section provides protection from impact to the user's body.

2. The athletic protector as in claim 1, said upper cup section being molded from material selected from the group consisting of polypropylene and polyethylene.

3. The athletic protector as in claim 1, said upper cup section being molded from high impact propylene and ethylene copolymer pellets.

4. The athletic protector as in claim 3, said upper cup section being molded from high impact propylene and ethylene copolymer pellets having a specific gravity in the range of 0.88 to 0.92 and a melting point greater than 150° C.

5. The athletic protector as in claim 3, said upper cup section being molded from high impact propylene and ethylene copolymer pellets meeting the specifications of CAS Registry #9010-79-1.

6. The athletic protector as in claim 1, said lower scrotal bridge section being molded from a thermal setting plastic rubber.

7. The athletic protector as in claim 6, said thermal setting plastic rubber being styrene-butadiene copolymers.

8. The athletic protector as in claim 6, said styrene-butadiene copolymers having a chemical formula $C_8H_8$,$C_4H_6$ and a specific gravity in the range of 0.90 to 0.95.

9. The athletic protector as in claim 6, said styrene-butadiene copolymers meeting the specifications of CAS Registry #9003-55-8.

10. The athletic protector as in claim 6, said thermal setting plastic rubber having a Shore A durometer in the range of 20 to 90.

11. The athletic protector as in claim 10, said thermal setting plastic rubber having a Shore A durometer in the range of 50 to 70.

12. The athletic protector as in claim 11, said thermal setting plastic rubber having a Shore A durometer in the range of 55 to 65.

13. The athletic protector as in claim 1, said resilient section being molded from a thermal setting plastic rubber.

14. The athletic protector as in claim 13, said thermal setting plastic rubber being styrene-butadiene copolymers.

15. The athletic protector as in claim 13, said styrene-butadiene copolymers having a chemical formula $C_8H_8$,$C_4H_6$ and a specific gravity in the range of 0.90 to 0.95.

16. The athletic protector as in claim 13, said styrene-butadiene copolymers meeting the specifications of CAS Registry #9003-55-8.

17. The athletic protector as in claim 6, said thermal setting plastic rubber having a Shore A durometer in the range of 20 to 50.

18. The athletic protector as in claim 10, said thermal setting plastic rubber having a Shore A durometer in the range of 25 to 35.

19. The athletic protector as in claim 11, said thermal setting plastic rubber having a Shore A durometer in the range of approximately 30.

20. A multi-part athletic protector comprising:

a rigid, upper cup section sized to protect the upper male groin area from impact molded from propylene and ethylene copolymer pellets;

a semi-rigid lower scrotal bridge section joined along the upper margin thereof to said upper cup section molded from thermal setting plastic rubber having a Shore A durometer in the range of 55 to 65 and adapted for longitudinal and lateral flexion while covering the lower male groin area; and a resilient cushioning section molded from thermal setting plastic rubber having a Shore A durometer in the range of 25 to 35 and joined to said cup section and said bridge section to cover the outer peripheral edges of said upper and lower cup sections and to overlie the entire interior surfaces of said upper cup and lower bridge sections;

whereby said resilient section provides cushioned contouring of the athletic cup to the user's body, said bridge section provides flexion in at least two different directions to minimize restriction of movement of the user's body, and said cup section provides hard-shell protection from impact to the user's body.

* * * * *